US008474823B2

(12) United States Patent
Matthews et al.

(10) Patent No.: US 8,474,823 B2
(45) Date of Patent: Jul. 2, 2013

(54) SYSTEM AND METHOD FOR GENERATING, FUNDING, AND DISTRIBUTING MULTIPLE JACKPOTS

(75) Inventors: Ian Matthews, Hertford (GB); Paul Fraser, Estepona Malaga (ES); Damon Barnard, Cadiz (ES)

(73) Assignee: PartyGaming IA Limited, Hamilton (BM)

( * ) Notice: Subject to any disclaimer, the term of this patent is extended or adjusted under 35 U.S.C. 154(b) by 309 days.

(21) Appl. No.: 12/911,147

(22) Filed: Oct. 25, 2010

(65) Prior Publication Data

US 2012/0098201 A1 Apr. 26, 2012

(51) Int. Cl.
*A63F 1/00* (2006.01)

(52) U.S. Cl.
USPC ..... 273/303

(58) Field of Classification Search
None
See application file for complete search history.

(56) References Cited

U.S. PATENT DOCUMENTS

| | | | | |
|---|---|---|---|---|
| 5,393,067 | A * | 2/1995 | Paulsen et al. | 273/292 |
| 5,564,700 | A * | 10/1996 | Celona | 463/27 |
| 5,810,354 | A | 9/1998 | Banyai | |
| 6,007,424 | A | 12/1999 | Evers et al. | |
| 6,102,400 | A | 8/2000 | Scott et al. | |
| 6,102,402 | A * | 8/2000 | Scott et al. | 273/292 |
| 6,206,782 | B1 * | 3/2001 | Walker et al. | 463/25 |
| 6,309,298 | B1 * | 10/2001 | Gerow | 463/20 |
| 6,309,299 | B1 * | 10/2001 | Weiss | 463/20 |
| 6,802,773 | B2 * | 10/2004 | Moody | 463/13 |
| 7,195,243 | B2 | 3/2007 | Kenny et al. | |
| 7,204,756 | B2 * | 4/2007 | Jubinville et al. | 463/17 |
| 7,611,404 | B1 * | 11/2009 | Hilf et al. | 463/13 |
| 7,635,303 | B2 * | 12/2009 | Wright | 463/17 |
| 7,850,525 | B2 * | 12/2010 | Shimizu et al. | 463/31 |
| 8,016,660 | B2 * | 9/2011 | Walther et al. | 463/17 |
| 2005/0176490 | A1 * | 8/2005 | Wright | 463/17 |
| 2005/0239542 | A1 | 10/2005 | Olsen | |
| 2006/0281527 | A1 * | 12/2006 | Dunaevsky et al. | 463/20 |
| 2007/0015584 | A1 * | 1/2007 | Frenkel | 463/42 |
| 2007/0287520 | A1 * | 12/2007 | Nalker | 463/17 |

(Continued)

OTHER PUBLICATIONS

International Searching Authority (ISA/EPO), International Search Report and Written Opinion of the ISA, for PCT/EP2011/067168, Mailing Date Jan. 18, 2012 (10 pages).

(Continued)

*Primary Examiner* — Kurt Fernstrom
*Assistant Examiner* — Dolores Collins
(74) *Attorney, Agent, or Firm* — Beem Patent Law Firm

(57) ABSTRACT

A method and system of generating, funding, and distributing multiple jackpots in a game such as poker, specifically such as Texas Hold 'Em. The jackpots may be separate, independent bad beat jackpots that pay out at different intervals due to having independent triggering conditions that have different odds of occurring. Preferably, the triggering condition for each jackpot may be a losing player's hand strength. The specific values for the triggering conditions may be chosen by random, may be generally evenly distributed over the number of jackpots, may be determined by an algorithm, e.g., one that relies on the odds of each hand occurring, or by another method. The jackpots may be funded from rakes collected from substantially every hand that is played—subject to certain prerequisites being established—such that each jackpot may be considered progressive in that it grows over time.

18 Claims, 1 Drawing Sheet

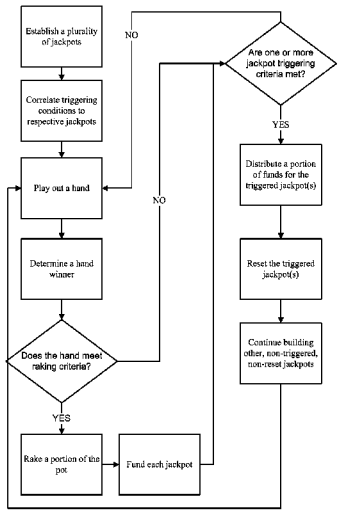

U.S. PATENT DOCUMENTS

| | | | | |
|---|---|---|---|---|
| 2008/0015006 | A1 | 1/2008 | George et al. | |
| 2008/0182653 | A1* | 7/2008 | O'Halloran et al. | 463/25 |
| 2008/0261683 | A1 | 10/2008 | Russell et al. | |
| 2009/0117972 | A1* | 5/2009 | Cava | 463/20 |
| 2009/0275400 | A1* | 11/2009 | Rehm et al. | 463/27 |
| 2011/0263320 | A1* | 10/2011 | Tara | 463/27 |
| 2011/0269521 | A1* | 11/2011 | Walther et al. | 463/17 |

OTHER PUBLICATIONS

Jesse Knight, Quads Poker Hand—Four of a Kind—Poker Hand Rankings, viewable at: http://www.poker-babes.com/poker/definitions/quads/, first viewed Jun. 17, 2010.

* cited by examiner

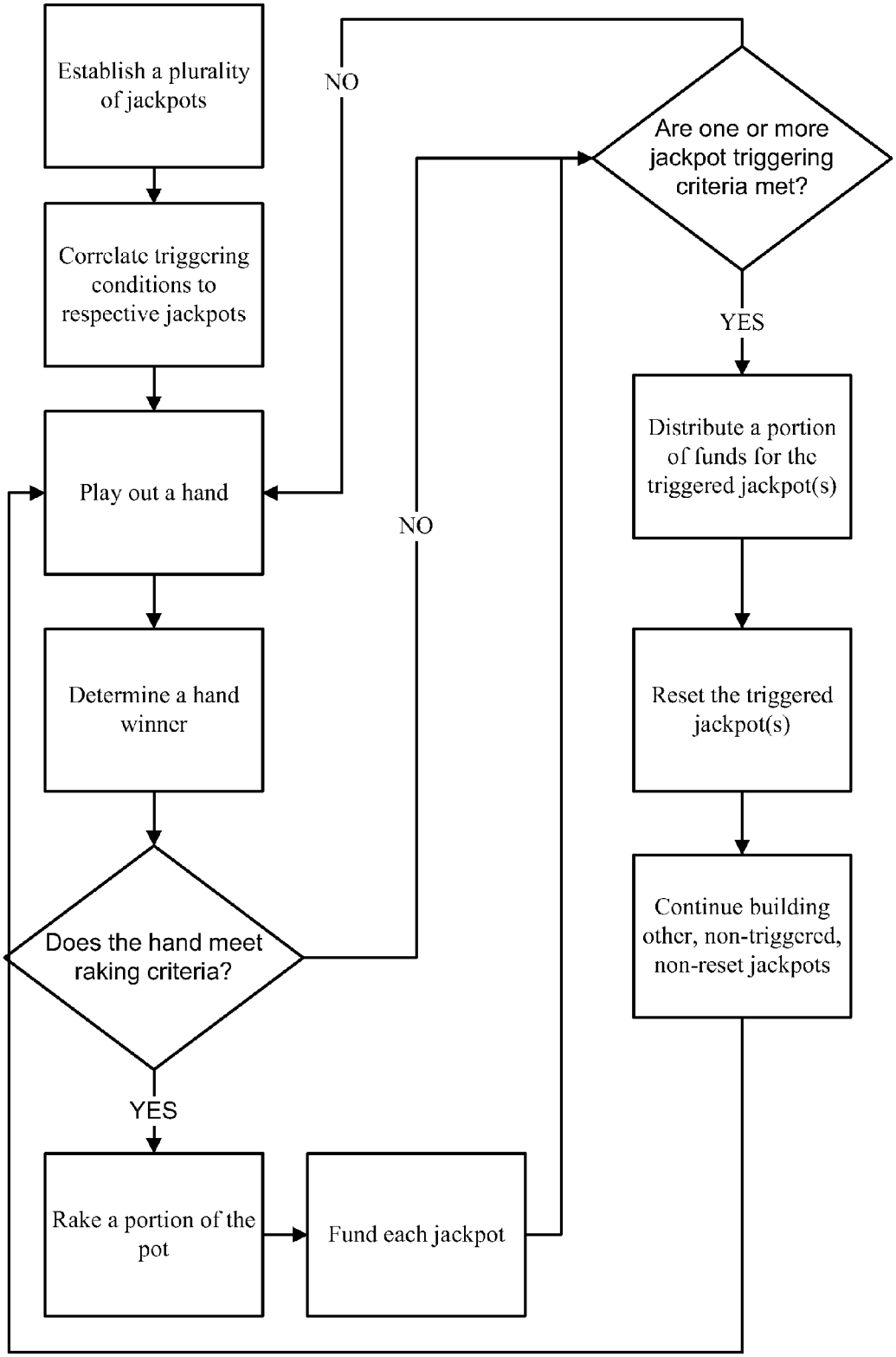
Establish a plurality of jackpots
Correlate triggering conditions to respective jackpots
Play out a hand
Determine a hand winner
Does the hand meet raking criteria?
YES
NO
Rake a portion of the pot
Fund each jackpot
Are one or more jackpot triggering criteria met?
NO
YES
Distribute a portion of funds for the triggered jackpot(s)
Reset the triggered jackpot(s)
Continue building other, non-triggered, non-reset jackpots

SYSTEM AND METHOD FOR GENERATING, FUNDING, AND DISTRIBUTING MULTIPLE JACKPOTS

BACKGROUND OF THE INVENTION

1. Field of the Invention

The present invention is directed to a system and method for generating, funding, and distributing multiple jackpots in a game.

2. Description of the Related Art

Bad beat jackpots may be used in games such as poker to provide added incentive to draw players to a group of poker tables. Under traditional rules, a player may win a bad beat jackpot if his hand meets or exceeds some threshold strength but still loses to another player, who holds an even stronger hand. For example, a player may hold four 10s, which is a fairly rare hand, and lose to a player with a straight flush, which generally is an even more rare hand.

Winning a bad beat jackpot may involve distributing a first portion of funds to the player that lost the hand, a second portion to the hand winner, and a third portion spread among the other players at that table. In this way, multiple players may benefit from the bad beat hand.

In general, each hand that is played without the jackpot being hit adds to the total jackpot value. Once the jackpot is won, however, the amount of the jackpot may be reset or at least substantially reduced to a base value. At this point and for a while thereafter, players may become disinterested in the bad beat tables because of the low jackpot value. These players may leave the tables until the jackpot reaches a large enough value to entice them to return. With fewer players playing at bad beat tables and, consequently, with fewer total bad beat tables being used, fewer hands may be played, causing the jackpot to increase more slowly. In addition, because funds are collected from each hand at these tables, with a portion of those funds going to the house, fewer tables being played may lead to decreased revenues for the house or the system operator.

Moreover, while some players may be attracted to the bad beat tables for the prospect of hitting a large bad beat jackpot, other players may be more wary of playing at those tables when comparing the additional cost required to play versus the odds of hitting the jackpot. To these players, the bad beat jackpot may hit too infrequently to justify playing at a table where a portion of the winnings goes to the house and also funds the jackpot.

What is needed is a game that overcomes the drawbacks described above.

BRIEF SUMMARY OF THE INVENTION

In one aspect, a method for generating, funding, and distributing multiple jackpots in a game played by a plurality of players may comprise: establishing a plurality of jackpots, each jackpot having at least one triggering condition independent from others of the plurality of jackpots; funding each jackpot from a portion of a plurality of pots corresponding to a plurality of hands played in the game; verifying that a triggering condition for one of the jackpots is met; distributing at least a portion of the funds for one of the jackpots to a predetermined subset of the plurality of players; maintaining funds for others of the jackpots in those jackpots until triggering conditions for those jackpots are met; and resetting the distributed jackpot. The game may be Texas Hold 'Em, and the plurality of jackpots may be bad beat jackpots. In addition, the triggering condition may be a losing player's hand, i.e., it may be a strong hand that loses to an even stronger hand. The game may include more triggering conditions than jackpots, and the method may include the further step of correlating each of the triggering conditions to a jackpot based on one or more preselected criteria, such as the odds of the triggering condition occurring.

In the game, each portion taken from the plurality of pots to fund the jackpots may be substantially equal. When each jackpot is paid, the method also may retain a second portion of the funds for one of the jackpots, e.g., prior to the distributing step, in order to re-fund the jackpot during the resetting step. The method also may include displaying statistical information about each of the jackpots to a plurality of players. This statistical information may be more than just the jackpot values and may include things such as the length of time since the jackpot last was won, the number of hands since the jackpot was won, etc.

In another aspect, a method for generating, funding, and distributing a plurality of jackpots in a poker game played by a plurality of players, the game comprising a plurality of hands, may comprise: determining a winner for one hand; verifying that at least one raking prerequisite is met for that hand; raking a portion of a pot for that hand; dispersing that portion among the plurality of jackpots; determining a winner for a later hand; determining at least one loser for that later hand; verifying that the loser has a card combination relating to at least one of the jackpots; and awarding at least a portion of that jackpot. The dispersing step may comprise dividing the portion collected from each pot by the number of jackpots to generate substantially equal amounts and then allocating each of those substantially equal amounts to each of the jackpots. In addition, the jackpot may be divided amongst the players, such that the awarding step may include: awarding a first portion to the later hand loser; awarding a second portion to the later hand winner; and awarding a third portion to other players in the later hand, preferably by distributing that third portion substantially equally among the other players. In addition, the first portion that is awarded to the hand loser may be larger than the other portions.

The method also may include the steps of: determining a winner for an even later hand; determining at least one later loser for that even later hand; verifying that that later loser has a card combination relating to a different jackpot; and awarding at least a portion of that different jackpot.

The plurality of jackpots may be bad beat jackpots, and each bad beat jackpot may have a different minimum losing hand requirement to trigger the jackpot. However, each of the bad beat jackpots also may have a plurality of substantially identical prerequisites. For example, to win any of the jackpots, the losing player may have to use both hole cards to form his hand.

In still another aspect, a method for generating, funding, and distributing a plurality of bad beat jackpots in a poker game played by a plurality of players may comprise: selecting a plurality of jackpot-eligible losing player hands from among all possible player hands; allocating a first subset of the jackpot-eligible losing player hands to a first bad beat jackpot; allocating a second subset of the jackpot-eligible losing player hands to a second bad beat jackpot; funding each of the plurality of bad beat jackpots with a portion of each pot that is collected, i.e., from substantially all of hands that are played; analyzing a losing player's hand to determine if it is a jackpot-eligible losing player hand and, if so, to determine which of the bad beat jackpots applies; and distributing at least a portion of the applicable bad beat jackpot to the losing player that has the jackpot-eligible losing player hand.

There may be between about three and about six jackpots, and in one embodiment, about four jackpots. The subsets of jackpot-eligible losing player hands may comprise player hands having similar player hand titles. For example, all eligible straight flushes may be linked to a first bad beat jackpot, all eligible four-of-a-kind hands may be linked to a second jackpot, all eligible full house hands may be linked to a third jackpot, etc. With respect to full houses, full houses, aces full of "x" may be one hand title, kings full of "y" may be a second hand title, queens full of "z" may be a third hand title, etc.

Players may play the poker game in person or on a plurality of computers connected via the Internet. In the latter case, the method may include allowing one or more of the players to play concurrently at more than one of the plurality of tables.

These and other features and advantages are evident from the following description of the present invention, with reference to the accompanying drawings.

BRIEF DESCRIPTION OF THE SEVERAL VIEWS OF THE DRAWINGS

FIG. 1 is an exemplary process flow of one method for conducting a game with a plurality of bad beat jackpots.

DETAILED DESCRIPTION

A system and method for conducting a game with a multi-tiered bad beat jackpot. As described below, each jackpot may be funded from qualifying hands. The odds of a qualifying bad beat hand being achieved may vary for each jackpot. As such, certain jackpots may pay out more often than other jackpots, enticing players with the prospect of winning a more frequent jackpot. Relatedly, those jackpots that do not hit as often may grow in value, enticing players to play the game with the hope of hitting one or more of the jackpots. One exemplary process flow for carrying out the method is shown in FIG. 1, although variations and other steps, including those described herein, are possible.

In one embodiment, the game is a poker game, although other games are within the scope of this invention. Preferably, the game includes a series of hands, the opportunity for betting during each hand—including at one or more separate occasions during the hand, and a predetermined rule set for determining the winner of each hand. For illustrative purposes, the method will be described with respect to a game of Texas Hold 'Em, and the rules for determining the hand winner may be those generally understood as being those for Texas Hold 'Em.

The game may include a plurality of players playing at one or more tables. The action between players at one table may be independent of the action between players at another table. However, the jackpot may be funded from the pots of each table, and all players may be eligible for the jackpot, regardless of their table.

Each hand that is played at a table provides the players at that table with the opportunity to wager or to fold, with wagers going to increase the pot for that hand. In one embodiment, the game also includes blind wagers that automatically are collected from one or more players, whether or not they decide to play the hand or sit out. For example, a small blind may be collected from the player to the left of the dealer, and a big blind (often twice the small blind value) may be collected from the player to that player's left. Blind amounts may be predetermined values or dynamic values. In the latter case, the game may include predetermined criteria for increasing blind values, e.g., blind values may increase after a predetermined passage of time, after a predetermined number or percentage of players (at that table or, more likely, from among all participating tables) have been eliminated, etc.

In order to fund the multiple bad beat jackpots, a portion of each pot may be collected, i.e., "raked," instead of going towards increasing the hand winner's chip count or winnings amount. This raked amount may be a predetermined absolute amount or, alternatively, it may be a predetermined percentage of the pot value. In one embodiment, the rake may be collected for each hand that is played. In another embodiment, whether a rake is collected may depend on one or more criteria being met before a hand winner is determined. For example, the game may require that the hand has progressed to a certain threshold point. In the case of Texas Hold 'Em, this may mean, e.g., that the hand winner is not determined before the flop, turn, or river is dealt. In the first case, this may exempt hands where one player wins pre-flop, e.g., by making a large bet that causes the other players to fold.

Alternatively, the method may require that a minimum pot value be established to trigger collecting a rake. For example, the system may require a minimum pot level of $10 to trigger raking jackpot contributions. If blind levels are $1 and $2, the system requires at least an additional $7 in wagering from the players to trigger the rake.

If blind values change as the game progresses, so too may the minimum pot value required to collect a rake. For example, the minimum value may be calculated as a predetermined multiple of a blind value or as some other increase over the blind value. In this manner, as blinds increase, so may the minimum pot value required for a rake.

Alternatively, the minimum pot value may remain generally constant. Depending on the value selected, as blinds increase, the threshold blind amount automatically may be reached with payment of the blinds, so that at least this criterion may be satisfied for every hand played thereafter. In the example above, if blinds increase to $5 and $10, the pot, at a minimum, is $15, and the $10 minimum threshold is reached.

The raked amount may serve a plurality of purposes, including funding each of the bad beat jackpots discussed below. Additionally, a portion of the rake may go to fund another jackpot, or it may go to the house. The rake distribution may be established using predetermined criteria; however, for explanatory purposes, the portion of the rake that does not fund the jackpots may be disregarded, and the method is described herein with substantially the entire rake going to fund the bad beat jackpots.

In one embodiment, the amount raked from each hand to fund the jackpots may be generally constant, regardless of the blind level, pot value, game stage, or other factors. In another embodiment, the raked amount may be variable. It may vary as the game progresses, e.g., more may be raked as blind values increase. Similarly, raked amount may be a predetermined percentage or factor of one of the blind values. Alternatively, raked amount may be pot-dependent, such as by setting raked amount to be a predetermined percentage or factor of the ultimate pot value.

As stated above, the system may include a plurality of bad beat jackpots, e.g., about 4 jackpots, although more or fewer jackpots may be included. For the sake of description, jackpots may be described in terms of "n" levels. The levels may provide players with an indication of the requirements for winning each respective jackpot and the relative odds of winning that jackpot.

Because each raked hand contributes to each of the bad beat jackpots, the jackpots may be describes as "progressive," since they increase in value with each hand that is played without the jackpot being won. Preferably, the system funds each of the bad beat jackpots equally from the rake so that each grows at substantially the same amount for each hand that is played. For "n" levels, (rake amount/n) may be added to each jackpot from each raked hand. (Again, this amount may be modified to account for a portion of the rake being allocated to something other than the bad beat jackpots, but that factor is omitted for illustrative purposes.)

Staying with the four level example, levels 1 through 4 may be arranged in a predetermined order, such as in decreasing or increasing odds of payout. For purposes of discussion herein, level 1 may offer the longest odds of winning, with odds increasing for levels 2 through 4.

Each level may be independent although, as discussed above, certain conditions common to each level may be required to be eligible to win any jackpot at any level. For example, one or more of hand winner and bad beat winner may have to rely on both of their hole cards, or the hand must progress to a showdown stage between at least two players. In the case of Texas Hold 'Em, this may require that the hole cards be dealt to the players, and then that the community flop, turn, and river cards also be dealt. In addition to these common preconditions, however, each level may have at least one triggering condition different from the other levels.

Preferably, this distinct triggering condition may be the strength of the losing hand. Level 1 may be triggered by a player with a straight flush losing to a player with a higher straight flush. Level 2 may be triggered by a player losing with a minimum hand of four of a kind, Jacks or better. Level 3 may be triggered by a player losing with a minimum hand of four of a kind, 8s or better. Level 4 may be triggered by a player losing with a minimum hand of any full house. Each of these losing hands are exemplary and may be changed or adjusted and still be within the scope of the invention.

Although these hands may be chosen generally at random, the system and method alternatively may include an algorithm for determining the minimum threshold hand for each level. In one embodiment, the algorithm may comprise determining a total number of potential hands from the lowest hand eligible for any level to the best possible losing hand and then dividing those hands generally equally among the number of levels. One variation of this embodiment may consider all four of a kinds to be one "hand," while another variation may consider each four of a kind to be a separate hand, i.e., there are thirteen possible four of a kind hands for a standard deck of playing cards.

In another embodiment, the algorithm may estimate, calculate or otherwise retrieve or determine odds for achieving each of the possible qualifying hands or for achieving the hand and also losing. The system then may set the range for each level as all hands having odds between two levels. For example, level 4 may include all hands having odds less than 0.1% and greater than or equal to 0.05%, level 3 may include all hands having odds less than 0.05% and greater than or equal to 0.01%, etc. In this example, the upper bound for each level is considered open and the lower bound closed, although the opposite or other variations are possible.

If a player has a qualifying hand and still loses to another player with a stronger hand, the jackpot may be triggered. Preferably, only the highest-hand level that qualifies is implicated. For example, if the player has four queens and loses to a player with four kings, only level 2 may be triggered. Levels 3 and 4 may be unaffected, even though the player's hand may exceed the minimum requirement for each of those levels. As such, winning one jackpot may not reduce the balance in the other jackpots. In an alternative embodiment, however, the player may trigger all jackpots having minimum hand requirements at or below the player's hand. In this case, the payouts for all triggered jackpots may be pooled, with this sum then paid out.

Because the odds of hitting the jackpots are unequal, some jackpots may be triggered more frequently than others. For example, with the levels described above, it is likely that level 4 will be triggered most frequently, level 3 less frequently, etc., with level 1 triggered comparatively rarely. As such, the level 1 jackpot may grow significantly larger than the level 4 jackpot, enticing players to play for the chance of "hitting it big." Additionally, the level 4 jackpot (and the other level jackpots) may entice players to play at these tables, knowing that these jackpots pay out more frequently, albeit at a lower average value.

When a jackpot is triggered, the payout may be accomplished according to traditional bad beat jackpot rules. For example, about 50% of the payout may go to the loser of the hand, about 25% may go to the hand winner, and the remaining about 25% may be distributed among the other players at the table. These percentages are exemplary and may be modified. For example, some other payout, including the entire payout, may be payable to the hand loser.

The system preferably does not distribute all of the funds collected for a given level's jackpot when that jackpot is hit, although it may display to users the total amount of the payout that is available. For example, when aggregating all of the raked hand contributions up to the point that a jackpot is hit, the sum may be $50,000. However, an amount or percentage, e.g., about $10,000 or about 10%, respectively, may be retained and not available to be won. As such, in the former case, the system may display to players that the potential jackpot may be about $40,000, which is the amount that may be paid out when the jackpot is hit. In the latter case, the displayed potential jackpot may be about $45,000. At least a portion of the remaining balance may be used to fund the next jackpot for that level. The amount or percentage that is withheld from the jackpot preferably may be predetermined, but it alternatively may be open to dynamic adjustment, e.g., in the event that the jackpot pays out more or less often than initially desired.

Preferably, the independent criteria for each level are predetermined so that players know what hands are required to trigger each jackpot level. In addition, this may make it easier for the system administrator to track and predict payouts, since the odds of the jackpots being hit preferably will remain substantially constant. In another embodiment, however, the criteria may be adjusted dynamically. This may allow the system administrator to make a payout more or less likely to occur. For example, the level 1 jackpot may have not been triggered for a longer time than the system administrator might like, and it may have a disproportionately large jackpot. In that case, instead of making the qualifying hand be a straight flush that loses to a higher straight flush, the triggering hand may be modified to include, e.g., four of a kind, kings or better.

The system also may include a notification distributed to current and/or potential players to advise them of this change, which, in turn, may drive more activity to the tables by players looking to win the large jackpot. In addition, regardless of any potential changes in qualifying criteria or odds, the system may include a notification or display presenting information about each jackpot to current and/or potential players. This information may include each jackpot's value, an average time and/or number of hands between payouts for each jackpot, an average payout value for each jackpot, number of hands played, days, etc., since each jackpot was hit, historical maximum and minimum jackpot values and time/hand intervals between payouts, etc. Preferably, this information may be compiled and displayed substantially in real-time.

The system and method may be carried out by players in person, such as in a casino setting. In this embodiment, each player may be limited to playing generally only one hand at one table. Each table may include a predetermined maximum and/or minimum number of players, playing with tangible cards, chips, etc.

Alternatively, the system may be computerized. For example, players may download gaming software onto their computers that may connect them with players at other computers around the world. Each player's computer may transmit and receive information to at least one central server or other computer in order to carry out the hands and to display relevant information to each player.

The player's computer may include a display showing one or more tables in one or more windows at which the player is seated. Each window may include information such as: the current blind levels; the position of the dealer; the player's hole cards; any community cards that have been dealt; whether other players at the table are playing, are sitting out, or have folded; the pot value; each player's chip count; and/or the current jackpot values for each level. Players may be able to play at multiple tables, with information for each table contained in separate, respective windows.

In still another embodiment, the system may combine in-person and electronic tables. For example, both tables in a casino and electronic tables may contribute to, and be eligible for, the various bad beat jackpots. Each table, whether in-person or electronic, preferably follows the same rule set so that all players have an equal opportunity to win one or more of the bad beat jackpots.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. A method for generating, funding, and distributing multiple jackpots in a game played by a plurality of players playing said game on a plurality of computers in communication with at least one central computer having a processor, said at least one central computer carrying out steps comprising:

establishing a plurality of jackpots, each jackpot having at least one triggering condition independent from others of said plurality of jackpots;

funding each jackpot from a portion of a plurality of pots corresponding to a plurality of hands played in said game;

verifying, by said processor, that a triggering condition for one of said jackpots is met, wherein said triggering condition is a losing player's hand meeting or exceeding a threshold hand in said game;

distributing at least a portion of said funds for one of said jackpots to a predetermined subset of said plurality of players;

maintaining funds for others of said jackpots in said jackpots until triggering conditions for said others of said jackpots are met; and resetting said distributed jackpot.

2. A method according to claim 1, wherein said game is Texas Hold 'Em.

3. A method according to claim 1, wherein said plurality of jackpots are bad beat jackpots.

4. A method according to claim 1, wherein each portion from said plurality of pots is substantially equal.

5. A method according to claim 1, wherein said game includes a greater number of triggering conditions than jackpots, said method further comprising:

correlating each of said triggering conditions to a jackpot based on odds of said triggering condition occurring.

6. A method according to claim 1, further comprising:

retaining a second portion of said funds for one of said jackpots prior to said distributing step in order to re-fund said jackpot during said resetting step.

7. A method according to claim 1, further comprising:

displaying statistical information about each of said jackpots, in addition to values of said jackpots, to said plurality of players.

8. A method for generating, funding, and distributing a plurality of jackpots in a poker game played by a plurality of players, said game comprising a plurality of hands, said plurality of players playing said game on a plurality of computers in communication with at least one central computer having a processor, said at least one central computer carrying out steps comprising:

determining a winner for one hand of said plurality of hands;

verifying, by said processor, that at least one raking prerequisite is met for said one hand;

raking a portion of a pot for said one hand;

dispersing said portion among said plurality of jackpots;

determining a winner for a later hand of said plurality of hands;

determining at least one loser for said later hand;

verifying, by said processor, that said at least one loser has a card combination relating to at least one of said plurality of jackpots; and awarding at least a portion of one of said plurality of jackpots;

wherein said plurality of jackpots are bad beat jackpots, said bad beat jackpots having different minimum losing hand requirements.

9. A method according to claim 8, wherein said dispersing step comprises:

dividing said portion by the number of jackpots to generate substantially equal amounts; and allocating a different one of said substantially equal amounts to each of said jackpots.

10. A method according to claim 8, wherein said awarding step comprises:

awarding a first portion to said at least one later hand loser;

awarding a second portion to said at least one later hand winner; and awarding a third portion to other players in said later hand, wherein said third portion is distributed substantially equally among said other players, wherein said first portion is larger than said second portion and said third portion.

11. A method according to claim 8, further comprising:

determining a winner for an even later hand of said plurality of hands;

determining at least one later loser for said even later hand;

verifying that said at least one later loser has a card combination relating to a different one of said plurality of jackpots; and awarding at least a portion of said different one of said plurality of jackpots.

12. A method according to claim 8, wherein said bad beat jackpots have a plurality of substantially identical prerequisites.

13. A method for generating, funding, and distributing a plurality of bad beat jackpots in a poker game played by a plurality of players, said game comprising a plurality of hands, said plurality of players playing said game on a plurality of computers in communication with at least one central computer having a processor, said at least one central computer carrying out steps comprising:

selecting a plurality of jackpot-eligible losing player hands from among all possible player hands;

allocating a first subset of said plurality of jackpot-eligible losing player hands to a first bad beat jackpot;

allocating a second subset of said plurality of jackpot-eligible losing player hands to a second bad beat jackpot;

funding each of said plurality of bad beat jackpots with a portion of each pot collected from substantially all of said plurality of hands;

analyzing, by said processor, a losing player's hand to determine if it is a jackpot-eligible losing player hand and, if so, to determine which of said plurality of bad beat jackpots applies; and distributing at least a portion of the applicable bad beat jackpot to the losing player having the jackpot-eligible losing player hand.

14. A method according to claim 13, wherein said plurality of bad beat jackpots comprises between about three and about six jackpots.

15. A method according to claim 13, wherein said subsets of jackpot-eligible losing player hands comprise player hands having similar player hand titles.

16. A method according to claim 13, wherein said collected pot portion is a predetermined value.

17. A method according to claim 13, wherein said plurality of players play said poker game on a plurality of computers connected via the Internet.

18. A method according to claim 17, wherein said game occurs at a plurality of tables, said method further comprising:

allowing one or more of said plurality of players to play concurrently at more than one of said plurality of tables.

* * * * *